US005491270A

United States Patent [19]

Chin et al.

[11] Patent Number: 5,491,270

[45] Date of Patent: Feb. 13, 1996

[54] BENZENE REDUCTION IN GASOLINE BY ALKYLATION WITH HIGHER OLEFINS

[75] Inventors: Arthur A. Chin, Cherry Hill; Nick A. Collins, Medford, both of N.J.; Mohsen N. Harandi, Langhorne, Pa.; Robert T. Thomson, Lawrenceville, N.J.; Robert A. Ware, Wyndmoor, Pa.

[73] Assignee: Mobil Oil Corporation, Fairfax, Va.

[21] Appl. No.: 278,713

[22] Filed: Jul. 22, 1994

Related U.S. Application Data

[63] Continuation of Ser. No. 28,058, Mar. 8, 1993, abandoned.

[51] Int. Cl.[6] ..... C07C 2/66

[52] U.S. Cl. ..... 585/467; 585/323; 585/446

[58] Field of Search ..... 585/323, 446, 585/467, 468

[56] References Cited

U.S. PATENT DOCUMENTS

| | | | |
|---|---|---|---|
| 3,729,409 | 4/1973 | Chen | 208/135 |
| 3,845,150 | 10/1974 | Yan et al. | 260/673.5 |
| 4,090,949 | 5/1978 | Owen et al. | 208/78 |
| 4,329,509 | 5/1982 | Haag et al. | 585/455 |
| 4,469,908 | 9/1984 | Burress | 585/467 |
| 4,594,143 | 6/1986 | Tabak | 585/467 |
| 4,746,762 | 5/1988 | Avidan et al. | 585/415 |
| 4,751,338 | 6/1988 | Tabak et al. | 585/415 |
| 4,753,720 | 6/1988 | Morrison | 208/135 |
| 4,778,661 | 10/1988 | Avidan et al. | 422/146 |
| 4,827,069 | 5/1989 | Kushnerick et al. | 585/415 |
| 4,855,521 | 8/1989 | Avidan et al. | 585/415 |
| 4,871,444 | 10/1989 | Chen et al. | 585/467 |
| 4,950,387 | 8/1990 | Harandi et al. | 208/49 |
| 4,992,607 | 2/1991 | Harandi et al. | 585/467 |
| 5,082,990 | 1/1992 | Hsieh et al. | 585/467 |
| 5,120,890 | 6/1992 | Sachtler et al. | 585/323 |
| 5,157,158 | 10/1992 | Berna Tejero et al. | 585/467 |
| 5,185,486 | 2/1993 | Collin et al. | 585/323 |
| 5,210,348 | 5/1993 | Hsieh et al. | 585/323 |

OTHER PUBLICATIONS

"Industrial Application of Shape Selective Catalysis", Chen et al., Catal. Rev.—Sci. Eng. 28(2&3), 247–249 (1986).

*Primary Examiner*—Ponnathapura Achutamurthy
*Attorney, Agent, or Firm*—A. J. McKillop; M. D. Keen

[57] ABSTRACT

A benzene-rich gasoline stream is alkylated with higher olefins in contact with a fluid bed of shape selective zeolite catalyst to produce a gasoline product stream reduced in benzene content wherein the high octane value alkylaromatics formed by benzene alkylation are of low carbon number, essentially C10–. Concurrently, a portion of olefins in the gasoline stream are converted to gasoline boiling range hydrocarbons and the sulfur content of the gasoline feedstream is lowered. Besides enhancing the octane value of the feedstream, the process results in a lower Reid vapor pressure and lower sulfur content.

23 Claims, No Drawings

BENZENE REDUCTION IN GASOLINE BY ALKYLATION WITH HIGHER OLEFINS

This is a continuation of application Ser. No. 08/028,058, filed Mar. 8, 1993, now abandoned.

BACKGROUND OF THE INVENTION

This invention relates to a process for the production of a more environmentally suitable gasoline by removing a substantial portion of benzene in gasoline by alkylation with $C_5$+ olefins wherein the alkylated aromatic product unexpectedly comprises essentially $C_{10}$– aromatics. Reid vapor pressure (RVP) is reduced and sulfur content is lowered.

The record of the development of environmental regulations at the Federal and State levels for the control of emissions from motor vehicles has moved from an early emphasis on end use control, as in the required application of catalytic converters to motor vehicles and standards on fleet fuel consumption, to a greater emphasis on changes in fuel composition. The first changes eliminated lead based octane enhancing additives in gasoline. More recently, compositional changes to gasoline dictated by environmental considerations include the reduction of low boiling hydrocarbon components, reduction in benzene content of gasoline and a requirement to substantially increase the oxygen content of formulated gasoline. Further regulations can be expected in the future, probably including regulations stipulating a reduction in the ASTM Distillation End Point of gasoline. The sum of the required changes to date presents an unprecedented technological challenge to the petroleum industry to meet these requirements in a timely manner with a product that maintains high octane value and is economically acceptable in the marketplace.

Gasolines manufactured to contain a higher concentration of aromatics such as benzene, toluene and xylenes (BTX) can adequately meet the octane requirements of the marketplace for a high octane fuel. Aromatics, particularly benzene, are commonly produced in refinery processes such as catalytic reforming which have been a part of the conventional refinery complex for many years. However, their substitution for the environmentally unsuitable lead-based octane enhancers is complicated by environmental problems of their own. Environmental and health related studies have raised serious questions regarding the human health effects of benzene. The findings suggest that exposure to high levels of benzene should be avoided with the result that benzene concentration in gasoline to enhance octane number is limited and controlled to a relatively low value.

When hydrocarbons boiling in the gasoline boiling range are reformed in the presence of a hydrogenation-dehydrogenation catalyst, a number of reactions take place which include dehydrogenation of naphthenes to form aromatics, dehydrocyclization of paraffins to form aromatics, isomerization reactions and hydrocracking reactions. The composition of the reformer effluent or reformate is shifted toward higher octane value product. Catalytic reforming primarily increases the octane of motor gasoline by aromatics formation but without increasing the yield of gasoline.

Reformates can be prepared by conventional techniques by contacting any suitable material such as a naphtha charge material boiling in the range of $C_5$ or $C_6$ up to about 380° F. (193° C.) with hydrogen in contact with any conventional reforming catalyst. Typical reforming operating conditions include temperatures in the range from about 800° F. (427° C.) to about 1000° F. (538° C.), preferably from about 890° (477° C.) up to about 980° F. (527° C.), liquid hourly space velocity in the range of from about 0.1 to about 10, preferably from about 0.5 to about 5; a pressure in the range from about atmospheric up to about 700 psig (4900 kPa) and higher, preferably from about 100 (700 kPa) to about 600 psig (4200 Kpa); and a hydrogen-hydrocarbon ratio in the charge in the range from about 0.5 to about 20 and preferably from about 1 to about 10.

The treatment of a reformate with crystalline aluminosilicate zeolites is known in the art and has included both physical treatments such as selective adsorption, as well as chemical treatments such as selective conversion thereof. In U.S. Pat. No. 3,770,614 to Graven a process combination is described for upgrading naphtha boiling range hydrocarbons by a combination of catalytic reforming and selective conversion of paraffinic components to enhance yield of aromatic hydrocarbons by contact with crystalline aluminosilicate catalyst having particular conversion characteristics. In U.S. Pat. No. 3,649,520 to Graven a process is described for the production of lead free gasoline by an integrated process of reforming, aromatics recovery and isomerization including $C_6$ hydrocarbons upgrading to higher octane product for blending.

U.S. Pat. No. 3,767,568 to Chen, incorporated herein by reference, discloses a process for upgrading reformates and reformer effluents by contacting them with specific zeolite catalysts so as to sorb methyl paraffins at conversion conditions and alkylate a portion of aromatic rings contained in the reformates.

Recently, a process has been developed to overcome some of the foregoing challenges in the reformulation of gasoline. The process is known in the art as the Mobil Benzene Reduction (MBR) process and is closely related to the Mobil Olefins to Gasoline (MOG) process. The MBR and MOG processes are described in U.S. Pat. Nos. 4,827,069 to Kushnerick, 4,950,387 and 4,992,607 to Harandi, and 4,746,762 to Avidan, all of common assignee. These patents are incorporated herein by reference.

The MBR process is a fluid bed process which uses shape selective, metallosilicate catalyst particles, preferably ZSM-5, to convert benzene to alkylaromatics using olefins from sources such a FCC or coker fuel gas, excess LPG, light FCC naphtha or the like. Benzene is converted, and light olefin is also upgraded to gasoline concurrent with an increase in octane value. Conversion of light FCC naphtha olefins also leads to substantial reduction of gasoline olefin content and vapor pressure. The yield-octane uplift of MBR makes it one of the few gasoline reformulation processes that is actually economically beneficial in petroleum refining.

The MBR process as practiced heretofore has relied upon light olefin as alkylating agent for benzene to produce alkylaromatic, principally in the $C_7$–$C_9$ range. However, some refineries have a surplus of higher carbon number olefins, i.e., $C_5$+ olefins, and it would be a benefit to the refiner if these olefins could be used in processes such as MBR. However, alkylation of benzene with such higher olefins would typically be expected to produce a sharp increase in the yield of alkylaromatics of $C_{11}$ carbon number and above as both mono and polyalkylated aromatics. This is not a preferred mode of operation or gasoline composition.

It is an object of the present invention to provide a process to lower the benzene content of gasoline while enhancing octane value by alkylation of benzene in a gasoline feedstock with higher carbon number olefins without substantially increasing the amount of high carbon number alkylaromatics in the product gasoline.

A further object of the invention is to provide the foregoing improved gasoline with a lower Reid vapor pressure and sulfur content.

SUMMARY OF THE INVENTION

The discovery has been made that a benzene-rich gasoline stream can be alkylated with higher olefins in contact with a fluid bed of shape selective zeolite catalyst to produce a gasoline product stream reduced in benzene content wherein the high octane value alkylaromatics formed by benzene alkylation are of low carbon number, essentially C10–. Concurrently during the alkylation reaction, a portion of olefins in the gasoline stream are converted to gasoline boiling range hydrocarbons and the sulfur content of the gasoline feedstream is lowered. Besides enhancing the octane value of the feedstream, the process results in a lower Reid vapor pressure.

A particularly surprising element of the invention is the production of substantially all $C_{10}$– alkylaromatics when benzene-rich gasoline is alkylated with $C_5$+ olefins according to the process of the invention. Ordinarily, alkylation of benzene with $C_5$+ olefins would be expected to produce a large quantity of $C_{11}$+ alkylaromatics by mono or poly alkylation with olefins. The novel chemistry of the instant process unexpectedly avoids the formation of such higher alkylaromatics leading to the formation of a high octane value gasoline product predominantly in the $C_5$–$C_9$ range.

More specifically, a fluid bed process for alkylating a benzene-rich gasoline boiling range hydrocarbon stream with a hydrocarbon stream comprising $C_5$+ olefins to produce gasoline having a reduced benzene content and containing aromatics comprising substantially $C_{10}$– alkylated aromatics has been discovered. The process comprises contacting the benzene-rich stream and the $C_5$+ olefin stream with solid, shape selective aluminosilicate catalyst particles in a fluidized catalyst bed under benzene alkylation conditions whereby an effluent stream is produced comprising gasoline having a reduced benzene content and containing aromatics comprising substantially $C_{10}$– alkylated aromatics.

A particular embodiment includes a process for the reduction of the benzene and olefin content of $C_5$+ FCC gasoline feedstream containing benzene and $C_5$+ olefins. The process comprises contacting the $C_5$+ FCC gasoline feedstream with solid, shape selective aluminosilicate catalyst particles in a fluidized catalyst bed under benzene alkylation conditions whereby the benzene in the feedstream is alkylated with the $C_5$+ olefins of the feedstream to produce an effluent stream comprising said gasoline having a reduced benzene and olefin content in which the aromatics which are present are substantially entirely $C_{10}$– alkylated aromatics.

The invention encompasses an improvement in the process for reducing the benzene content of reformate comprising alkylating a reformate feedstream with light olefins in contact with metallosilicate catalyst particles. The specific improvement embodies alkylating the reformate feedstream with a $C_5$ or $C_5$+ olefin rich feedstream whereby an effluent stream is produced comprising reformate having a reduced benzene content and containing aromatics comprising substantially $C_{10}$– alkylated aromatics.

DETAIL DESCRIPTION OF THE INVENTION

The present invention comprises an improvement to the Mobil Benzene Reduction process (MBR) generally described herein before and in the cited U.S. patents incorporated by reference. The invention provides a process for lowering the benzene content, olefin content, Reid vapor pressure and sulfur content of any benzene-rich $C_5$+ gasoline boiling range hydrocarbon feedstream while enhancing octane value. While these achievements are basic endowments of the MBR process when alkylation of benzene is carried out with light olefins, the present invention embodies the discovery that higher olefins, i.e., $C_5$+, can be used as alkylating agents in the MBR process without substantially increasing the production of higher, i.e., $C_{10}$+, alkylaromatics. In a preferred embodiment the invention provides a process integrated into the reformer section of a refinery for the manufacture of high octane gasoline. The invention can improve the economics of meeting the benzene specification of the gasoline pool, preferably reducing the pool benzene content below 1% or 0.8%.

One embodiment of the process of this invention resides in the conversion of a portion of a reformate or reformer effluent, or any benzene-rich $C_5$+ gasoline feedstream, following fractionation in a fractionation system. Portions subjected to conversion in the process are the $C_6$ fraction; also, the $C_6$ fraction plus at least a portion of the $C_9$+ or $C_{10}$+ fraction of the reformate containing aromatic and non-aromatic compounds. The conversion is carried out at conversion conditions with or without added hydrogen over a shape selective metallosilicate catalyst, preferably aluminosilicate.

Reformates or reformer effluents which are composed substantially of paraffinic and aromatic constituents can be prepared according to conventional techniques by contacting any suitable material such as naphtha charge material or heavy straight run gasoline boiling in the range of $C_5$ and preferably in the range of $C_6$ up to about 400° F. (204° C.) and higher with hydrogen at least initially in contact with any reforming catalyst. This is a conventional reforming operation which involves a net production of hydrogen and is well known to those skilled in the art as described in Chapter 6 of Petroleum Refining by James H. Gray and Glenn E. Handwerk as Published by Marcel Dekker, Inc. (1984).

Reforming catalysts in general contain platinum supported on an alumina or silica-aluminum base. Preferably, rhenium is combined with platinum to form a more stable catalyst which permits operation at lower pressures. It is considered that platinum serves as a catalytic site for hydrogenation and dehydrogenation reactions and chlorinated alumina provides an acid site for isomerization, cyclization, and hydrocracking reactions. Some impurities in the feed such as hydrogen sulfide, ammonia and organic nitrogen and sulfur compounds will deactivate the catalyst. Accordingly, feed pretreating in the form of hydrotreating is usually employed to remove these materials. Typically, feedstock and reforming products or reformate have the following analysis:

TABLE 1

| COMPONENT (vol %) | FEED | PRODUCT |
|---|---|---|
| Paraffins | 45–55 | 30–50 |
| Olefins | 0–2 | 0 |
| Naphthenes | 30–40 | 5–10 |
| Aromatics | 5–10 | 45–60 |

Reforming operating conditions include temperatures in the range of from about 800° F. (427° C.) to about 1000° F. (538° C.), preferably from about 890° (477° C.) up to about 980° F. (527° C.), liquid hourly space velocity in the range from about 0.1 to about 10, preferably from about 0.5 to about 5; a pressure in the range of from about atmospheric up to about 700 psig (4900 Kpa) and higher, preferably from about 100 (700 kPa) to about 600 psig (4200 Kpa); and a hydrogen-hydrocarbon ratio in the charge in the range from about 0.5 to about 20 and preferably from about 1 to about 10.

One aspect of the present invention is the incorporation of a process step comprising the fractionation of the reformate or reformer effluent, or $C_5$+ hydrocarbon feedstream. The fractionation step permits separation of the reformer effluent into several streams or fractions. These streams include a $C_6$ hydrocarbon fraction rich in benzene; also a fraction consisting of $C_6$+ and a portion of $C_9$+ aromatic rich hydrocarbons. These latter streams contain components of reformate that compromise the environmental acceptability of that product. It has been discovered in the present invention that all or a portion of these streams can be coprocessed by the MBR process in a fluid bed conversion zone containing shape selective aluminosilicate catalyst particles to upgrade these components to environmentally acceptable and high octane value gasoline constituents.

As noted earlier, any benzene-rich $C_5$+ gasoline boiling range hydrocarbon feedstream can be used in the MBR process, conventionally with a light olefins feedstream as alkylating agent. However, reformate is preferred. Benzene alkylation processes to reduce gasoline benzene content use light olefinic gas feedstocks containing ethene, propylene or butenes as the alkylating agent. Refinery olefinic streams typically include FCC offgas, fuel gas, and LPG. The reaction takes place over appropriate catalysts to produce alkyl aromatic hydrocarbons and improve gasoline octane and yield.

$C_5$+ olefins, it has been found, are also effective alkylating agents when used in conjunction with shape selective zeolite such as ZSM-5 catalysts in the Mobil Benzene Reduction (MBR) process. The alkylated aromatic products remain essentially $C_{10}$− aromatics. A number of sources of cracked gasoline streams in the refinery can be used as alkylating agent, including fluid catalytic cracking (FCC) gasoline or Thermafor catalytic cracking (TCC) gasoline, coker gasoline, and pyrolysis gasoline. Preferably, a light naphtha stream is used to maximize the olefin content of the stream as olefins tend to concentrate in the $C_5$–$C_7$ hydrocarbon range. Use of cracked gasoline feeds (i.e., $C_5$+ olefins) in other benzene alkylation processes will lead to formation of $C_{11}$+ aromatics. Also, other processes are more susceptible to catalyst poisoning which would be accelerated in the presence of naphtha feeds.

While not wanting to be bound by a theory of operation, it appears that in the present invention when the benzene-rich stream is coprocessed with $C_5$+ olefins over shape selective zeolite catalyst particles several reactions occur that lead to a substantial reduction in the benzene content of the product of the process and, simultaneously, a reduction in the Reid vapor pressure and sulfur content. These reactions, it is believed, include cracking, alkylation, and transalkylation. The $C_9$+ fraction containing aromatic and non-aromatic compounds, such as dialkylated aromatics, can enter into transalkylation reactions with benzene under the conditions of the process leading to the formation of $C_7$–$C_8$ alkylated aromatics from benzene. Also, cracking paraffins, particularly higher molecular weight normal and slightly branched paraffins, results in the production of compounds that are effective in alkylating benzene and further producing alkylated aromatics under the conditions of the conversion process.

Conversion of a benzene-rich gasoline feedstream used in the present invention in contact with metallosilicate catalyst particles is generally carried out at a temperature between 500° F. (260° C.) and about 1000° F. (538° C.) preferably between 550°– 900° F. (288°–482° C.) and most preferably between 700°–850° F. (371°– 454° C.). The pressure is generally between about 50 (350 Kpa) and 3000 psig (21000 kPa), preferably between 50–400 psig (350–2860 kPa). The liquid hourly space velocity, i.e., the liquid volume of hydrocarbon per hour per volume of catalyst is between 0.1 and 250, preferably between 1 and 100. A most preferable weight hourly space velocity based on total feed is between 0.5 and 3 WHSV. If hydrogen is charged, the molar ratio of hydrogen to hydrocarbon charged can be as high as 10 but it is preferably zero. Any type of catalytic reactor can be used in the process of the invention including fluid bed, fixed bed, riser reactor, moving bed, and the like. However, the dense phase turbulent fluid bed catalytic reactor is preferred.

The preferred catalysts are the intermediate pore size zeolites, of which ZSM-5 is the most favored. This zeolite is usually synthesized with Bronsted acid active sites by incorporating a tetrahedrally coordinated metal, such Al, Ga, or Fe, within the zeolitic framework. The ZSM-5 crystalline structure is readily recognized by its X-ray diffraction pattern, which is described in U.S. Pat. No. 3,702,866 (Argauer, et al.), incorporated by reference. The medium pore zeolites are favored for acid catalysis; however, the advantages of these zeolite materials may be utilized by employing highly siliceous materials or crystalline metallosilicate having one or more tetrahedral species having varying degrees of acidity.

The preferred catalysts for use in the conversion step of the present invention include the medium pore crystalline aluminosilicate zeolites having a silica to alumina ratio of at least 12, and constraint index of about 1 to 12. Representative of the zeolites of this type are ZSM-5, ZSM-11, ZSM-12, ZSM-22, ZSM-23, ZSM-35, MCM-22, and ZSM-48.

Other acidic materials which may be used include MCM-36 (described in U.S. Ser. Nos. 07/811,360 and 07/878,277) and MCM-49 (described in U.S. applications Ser. Nos. 07/802,938 and 07/987,850).

Representative of the larger pore zeolites (constraint index no greater than 2), which are useful as catalysts in the process of this invention, are zeolite Beta, TEA mordenite zeolite Y, especially USY and ZSM-12.

Zeolite Beta is described in U.S. Pat. No. Re. 28,341 (of original U.S. Pat. No. 3,308,069), to which reference is made for details of this catalyst.

Zeolite ZSM-12 is described in U.S. Pat. No. 3,832,449, to which reference is made for the details of this catalyst.

The method by which Constraint Index is determined is described fully in U.S. Pat. No. 4,016,218, to which reference is made for details of the method.

The preferred catalyst for use in the present invention is acidic ZSM-5 having an equilibrium alpha value less than 100, preferably less than 50. Alpha value, or alpha number, is a measure of zeolite acidic functionality and is more fully described together with details of its measurement in U.S. Pat. No. 4,016,218, *J. Catalysis*, 6, pp. 278–287 (1966) and *J. Catalysis*, 61, pp. 390–396 (1980).

A series of bench-scale pilot unit experiments (Examples 1–5 as described herein) were conducted which showed effective benzene reduction using heavier olefins as the alkylating agent. Two different cracked stocks were evaluated: a) light (215° F.) FCC gasoline and b) full range pyrolysis gasoline. Feedstock properties for these are given in Tables 3 and 4, respectively. These cracked gasolines were blended with benzene-rich reformate cuts in various proportions and charged to a fluid bed reactor containing acidic ZSM-5 catalyst. Operating conditions were as follows:

TABLE 2

| Example | 1 | 2 | 3 | 4 | 5 |
|---|---|---|---|---|---|
| Olefin Source | Lt FCC gasoline | Lt FCC gasoline | pygas | pygas | pygas |
| Vol % Olefin Source in blend | 50 | 75 | 30 | 30 | 14 |
| Temp, °F. | 800 | 800 | 750 | 800 | 800 |
| Press., psig | 75 | 75 | 180 | 150 | 190 |
| WHSV on feed, $hr^{-1}$ | 1.5 | 1.0 | 1.0 | 1.0 | 1.0 |

Material balances on Examples 1–5 were taken at 3 and 8 hours-on-stream. These detailed material balance data are shown in Tables 5–9.

Tables 5–9 show that benzene conversions for Examples 1–5 between 25% and 42% were obtained while producing only a very small amount of $C_{11}$+ alkyl aromatics, i.e., between 1.5 wt % and 7.5 wt %. A number of clean fuel benefits other than benzene reduction were also achieved. Reductions of at least 60 weight percent, or between 72% and 81%, for $C_5$+ olefins and between 0.5 and 1 psi for RVP were obtained. The ratio of $C_9$ to $C_{10}$ aromatics is at least 2.5:1. Significant sulfur conversion was also found, i.e., greater than 60 wt %. The detailed sulfur GC analysis on the feed and liquid product for MB-1 (three hours on-stream) of Example 2 (Table 10) shows over 70% conversion of both ring (thiophenic) and mercaptan sulfur species. An octane boost is also obtained. The magnitude of the uplift depends on the feedstock composition and reaction severity.

The use of $C_5$+ olefin feed as the sole alkylating agent in benzene reduction processes produces novel results as shown in Tables 5–10. The prior art specifies the use of light olefinic gas feeds ($C_2$–$C_4$ olefins). Over ZSM-5, heavy olefins are alkylated to form $C_7$–$C_{10}$ aromatics rather than heavier $C_{11}$+ aromatics. A number of unexpected clean fuel benefits including sulfur reduction are also obtained. These findings show that MBR effectively converts benzene using heavy olefins as the alkylating agent and provides added flexibility to the process. This can be especially attractive to refiners with limited light olefin availability.

TABLE 3

Feedstock Properties- Light FCC Naphtha (215-°F.)

| Composition, wt % | |
|---|---|
| Hydrogen | 0.0 |
| Methane | 0.0 |
| Ethane | 0.0 |
| Ethene | 0.0 |
| Propane | 0.0 |
| Propene | 0.0 |
| N-Butane | 0.9 |
| Isobutane | 0.4 |
| Butenes | 3.5 |
| Total $C_5$+ | 95.2 |
| $C_5$–$C_9$ Isoparaffins | 30.1 |
| $C_5$–$C_9$ N-Paraffins | 7.5 |
| $C_5$–$C_9$ Olefins | 44.4 |
| $C_5$–$C_9$ Naphthenes | 7.3 |
| $C_6$–$C_9$ Aromatics | 5.8 |
| $C_{10}$+ & unknowns | 0.1 |

TABLE 3-continued

Feedstock Properties- Light FCC Naphtha (215-°F.)

| | |
|---|---|
| Benzene | 2.3 |
| Toluene | 3.4 |
| Total Sulfur, ppmw | 242 |
| Mercaptan Sulfur, ppmw | 3 |
| Nitrogen, ppmw | 7 |
| $C_5$+ Properties | |
| R + O/M + O | 90.4/79.2 |
| Molecular Weight | 82.2 |
| Density @ 60° F., g/ml | 0.68 |
| Reid Vapor Pressure, psia | 9.9 |

TABLE 4

Feedstock Properties- Pyrolysis Gasoline

| Composition, wt % | |
|---|---|
| Butenes | 1.1 |
| Pentenes | 9.9 |
| Pentadienes | 2.3 |
| Other $C_5$ | 0.9 |
| Benzene | 13.1 |
| $C_6$ Olefins | 16.6 |
| Other $C_6$ | 0.2 |
| Toluene | 6.9 |
| $C_7$ Olefins | 8.6 |
| Other $C_7$ | 0.6 |
| $C_8$ aromatics | 3.2 |
| $C_8$ Olefins | 4.8 |
| Other $C_8$ | 0.9 |
| $C_9$ Olefins | 6.2 |
| Other $C_9$ | 4.3 |
| Other $C_{10}$+ | 20.5 |
| Total $C_9$– Olefins, wt % | 49.5 |
| Total Sulfur, wt % | 0.051 |
| Mercaptan Sulfur, ppmw | 129 |
| Nitrogen, ppmw | 29 |
| Bromine Number | 101.1 |
| Dienes, mmol/g | 1.3 |
| R + O | 94.4 |
| M + O | 77.5 |
| RVP, psia | 7.3 |

TABLE 5

Example 1: Material Balance Data
Feed: 50/50 v/v FCC Lt. Naphtha/Reformate Cut Blend

| Material Balance Number | Feed | 1 | 2 |
|---|---|---|---|
| Hours on Stream | — | 2 | 8 |
| Reactor Pressure, psig | — | 75 | 75 |
| Avg. Reactor Temperature, °F. | — | 800 | 799 |
| Total HC Feed WHSV, $hr^{-1}$ | — | 1.5 | 1.5 |
| Benzene/$C_2$–$C_9$ Olefins, mol/mol | 0.94 | 0.94 | 0.94 |
| Benzene/$C_2$–$C_9$ Olefins, wt/wt | 0.93 | 0.93 | 0.93 |
| $C_2$–$C_9$ Olefin Conversion, % | — | 63.7 | 50.1 |
| $C_5$–$C_9$ Olefin Conversion, % | — | 74.6 | 70.1 |
| Benzene Conversion, % | — | 32.3 | 29.5 |
| Composition, wt % of hydrocarbon | | | |
| Hydrogen | 0.00 | 0.01 | 0.03 |
| Methane | 0.00 | 0.02 | 0.06 |
| Ethane | 0.00 | 0.08 | 0.16 |
| Ethene | 0.00 | 0.09 | 0.33 |
| Propane | 0.00 | 2.77 | 2.93 |
| Propene | 0.00 | 0.77 | 1.60 |
| N-Butane | 0.24 | 2.45 | 2.07 |
| Isobutane | 0.09 | 3.33 | 2.69 |
| Butenes | 1.00 | 1.88 | 2.92 |
| Total $C_5$+ | 96.67 | 88.60 | 87.21 |
| $C_5$–$C_9$ Isoparaffins | 33.81 | 34.09 | 33.26 |
| $C_5$–$C_9$ N-Paraffins | 13.10 | 10.50 | 10.76 |

TABLE 5-continued

Example 1: Material Balance Data
Feed: 50/50 v/v FCC Lt. Naphtha/Reformate Cut Blend

| | | | |
|---|---|---|---|
| $C_5$–$C_9$ Olefins | 21.77 | 5.53 | 6.51 |
| $C_5$–$C_9$ Naphthenes | 5.61 | 5.22 | 5.37 |
| $C_6$–$C_9$ Aromatics | 24.32 | 27.00 | 27.43 |
| $C_{10+}$ & Unknowns | 0.05 | 6.25 | 3.87 |
| Benzene | 21.18 | 14.33 | 14.94 |
| Toluene | 3.09 | 4.05 | 3.88 |
| Ethylbenzene | 0.02 | 2.32 | 2.06 |
| Xylenes | 0.04 | 1.02 | 1.30 |
| $C_9$ Aromatics | 0.00 | 5.28 | 5.25 |
| $C_{10}$ Aromatics | 0.01 | 1.88 | 1.54 |
| $C_{10}$ P + O + N | 0.02 | 0.71 | 0.77 |
| $C_{11}$+ & Unknowns | 0.03 | 3.66 | 1.56 |
| $C_5$+ Properties | | | |
| R + O/M + O | 86.5/79.0 | 89.0/82.8 | 88.9/82.1 |
| Molecular Weight | 83.0 | 89.4 | 88.2 |
| Density @ 60° F., g/ml | 0.71 | 0.73 | 0.73 |
| Reid Vapor Pressure, psia | 7.4 | 6.4 | 6.5 |
| Sulfur, ppmw | 125 | 60[a] | 78[a] |

[a]- total liquid product

TABLE 6

Example 2: Material Balance Data
Feed: 75/25 v/v FCC Light Naphtha
(215-°F.)/Reformate Cut Blend

| Material Balance Number | Feed | 1 | 2 |
|---|---|---|---|
| Hours on Stream | — | 3 | 9 |
| Reactor Pressure, psig | — | 75 | 75 |
| Avg. Reactor Temperature, °F. | — | 801 | 801 |
| Total HC Feed WHSV, $hr^{-1}$ | — | 1.0 | 1.0 |
| Benzene/$C_2$–$C_9$ Olefins, mol/mol | 0.42 | 0.42 | 0.42 |
| Benzene/$C_2$–$C_9$ Olefins, wt/wt | 0.41 | 0.41 | 0.41 |
| $C_2$–$C_9$ Olefin Conversion, % | — | 75.5 | 61.6 |
| $C_5$–$C_9$ Olefin Conversion, % | — | 86.4 | 76.8 |
| Benzene Conversion, % | — | 43.5 | 42.6 |
| Composition, wt % of hydrocarbon | | | |
| Hydrogen | 0.00 | 0.05 | 0.04 |
| Methane | 0.00 | 0.14 | 0.10 |
| Ethane | 0.00 | 0.36 | 0.25 |
| Ethene | 0.00 | 0.32 | 0.43 |
| Propane | 0.00 | 6.16 | 4.64 |
| Propene | 0.00 | 1.24 | 1.76 |
| N-Butane | 0.35 | 3.86 | 3.14 |
| Isobutane | 0.13 | 5.35 | 4.25 |
| Butenes | 1.46 | 2.22 | 3.14 |
| Total $C_5$+ | 98.05 | 80.29 | 82.26 |
| $C_5$–$C_9$ Isoparaffins | 32.28 | 31.41 | 31.72 |
| $C_5$–$C_9$ N-Paraffins | 10.43 | 7.95 | 8.59 |
| $C_5$–$C_9$ Olefins | 31.48 | 4.28 | 7.31 |
| $C_5$–$C_9$ Naphthenes | 6.64 | 5.57 | 6.07 |
| $C_6$–$C_9$ Aromatics | 17.12 | 25.26 | 22.90 |
| $C_{10+}$ & Unknowns | 0.10 | 5.81 | 5.68 |
| Benzene | 13.66 | 7.72 | 7.84 |
| Toluene | 3.40 | 5.48 | 5.08 |
| Ethylbenzene | 0.03 | 2.67 | 2.26 |
| Xylenes | 0.03 | 3.98 | 2.56 |
| $C_9$ Aromatics | 0.00 | 5.41 | 5.16 |
| $C_{10}$ Aromatics | 0.00 | 1.55 | 1.33 |
| $C_{10}$ P + O + N | 0.04 | 0.30 | 0.29 |
| $C_{11}$+ & Unknowns | 0.06 | 3.96 | 4.06 |
| $C_5$+ Properties | | | |
| R + O/M + O | 87.5/79.4 | 90.3/82.8 | 90.1/82.4 |
| Molecular Weight | 82.9 | 90.3 | 90.1 |
| Density @ 60° F., g/ml | 0.70 | 0.73 | 0.73 |
| Reid Vapor Pressure, psia | 8.3 | 7.0 | 7.1 |
| Sulfur, ppmw | 170 | 72[a] | 97[a] |

[a]- total liquid product

TABLE 7

Example 3: Material Balance Data
Feed: 30/70 v/v Pyrolysis Gasoline/Reformate Cut Blend

| Material Balance Number | Feed | 1 |
|---|---|---|
| Hours on Stream | — | 3 |
| Reactor Pressure, psig | — | 180 |
| Avg. Reactor Temperature, °F. | — | 751 |
| Total HC Feed WHSV, $hr^{-1}$ | — | 1.0 |
| Benzene/$C_2$–$C_9$ Olefins, mol/mol | 3.43 | — |
| Benzene/$C_2$–$C_9$ Olefins, wt/wt | 3.25 | — |
| $C_2$–$C_9$ Olefin Conversion, % | — | 73.6 |
| $C_5$–$C_9$ Olefin Conversion, % | — | 81.1 |
| Benzene Conversion, % | — | 33.8 |
| Composition, wt % of hydrocarbon | | |
| Hydrogen | 0.00 | 0.00 |
| Methane | 0.00 | 0.02 |
| Ethane | 0.00 | 0.09 |
| Ethene | 0.00 | 0.03 |
| Propane | 0.00 | 3.68 |
| Propene | 0.00 | 0.28 |
| N-Butane | 0.00 | 2.65 |
| Isobutane | 0.00 | 3.05 |
| Butenes | 0.33 | 0.71 |
| Total $C_5$+ | 99.67 | 89.48 |
| $C_5$–$C_9$ Isoparaffins | 16.42 | 15.51 |
| $C_5$–$C_9$ N-Paraffins | 15.30 | 9.74 |
| $C_5$–$C_9$ Olefins | 12.42 | 2.35 |
| $C_5$–$C_9$ Naphthenes | 4.28 | 2.71 |
| $C_6$–$C_9$ Aromatics | 46.29 | 47.98 |
| $C_{10+}$ & Unknowns | 4.96 | 11.19 |
| Benzene | 41.42 | 27.44 |
| Toluene | 3.08 | 4.39 |
| Ethylbenzene | 0.26 | 3.81 |
| Xylenes | 0.64 | 1.71 |
| $C_9$ Aromatics | 0.89 | 10.64 |
| $C_{10}$ Aromatics | 0.72 | 3.40 |
| $C_{10}$ P + O + N | 0.54 | 0.44 |
| $C_{11}$+ & Unknowns | 3.70 | 7.35 |
| $C_5$+ Properties | | |
| R + O/M + O | 88.3/77.3 | 93.9/84.3 |
| Molecular Weight | 85.7 | 93.1 |
| Density @ 60° F., g/ml | 0.77 | 0.79 |
| Reid Vapor Pressure, psia | 4.9 | 4.0 |

TABLE 8

Example 4: Material Balance Data
Feed: 30/70 v/v Pyrolysis Gasoline/Reformate Cut Blend

| Material Balance Number | Feed | 1 | 2 |
|---|---|---|---|
| Hours on Stream | — | 3 | 8 |
| Reactor Pressure, psig | — | 150 | 150 |
| Avg. Reactor Temperature, °F. | — | 800 | 800 |
| Total HC Feed WHSV, $hr^{-1}$ | — | 1.0 | 1.0 |
| Benzene/$C_2$–$C_9$ Olefins, mol/mol | 3.43 | 3.43 | 3.43 |
| Benzene/$C_2$–$C_9$ Olefins, wt/wt | 3.25 | 3.25 | 3.25 |
| $C_2$–$C_9$ Olefin Conversion, % | — | 65.0 | 56.1 |
| $C_5$–$C_9$ Olefin Conversion, % | — | 77.1 | 74.6 |
| Benzene Conversion, % | — | 29.6 | 24.7 |
| Composition, wt % of hydrocarbon | | | |
| Hydrogen | 0.00 | 0.07 | 0.05 |
| Methane | 0.00 | 0.46 | 0.37 |
| Ethane | 0.00 | 0.87 | 0.87 |
| Ethene | 0.00 | 0.11 | 0.18 |
| Propane | 0.00 | 7.09 | 5.29 |
| Propene | 0.00 | 0.47 | 0.82 |
| N-Butane | 0.00 | 2.47 | 1.70 |
| Isobutane | 0.00 | 2.61 | 1.67 |
| Butenes | 1.33 | 1.04 | 1.45 |
| Total $C_5$+ | 99.67 | 84.81 | 87.61 |
| $C_5$–$C_9$ Isoparaffins | 16.42 | 12.31 | 13.97 |
| $C_5$–$C_9$ N-Paraffins | 15.30 | 8.13 | 9.54 |
| $C_5$–$C_9$ Olefins | 12.42 | 2.84 | 3.15 |

TABLE 8-continued

Example 4: Material Balance Data
Feed: 30/70 v/v Pyrolysis Gasoline/Reformate Cut Blend

| | | | |
|---|---|---|---|
| $C_5$–$C_9$ Naphthenes | 4.28 | 2.09 | 2.46 |
| $C_6$–$C_9$ Aromatics | 46.29 | 49.85 | 50.57 |
| $C_{10+}$ & Unknowns | 4.96 | 9.59 | 7.91 |
| Benzene | 41.42 | 29.17 | 31.19 |
| Toluene | 3.08 | 6.58 | 6.48 |
| Ethylbenzene | 0.26 | 5.71 | 5.29 |
| Xylenes | 0.64 | 2.12 | 1.99 |
| $C_9$ Aromatics | 0.89 | 6.27 | 5.62 |
| $C_{10}$ Aromatics | 0.72 | 2.71 | 2.09 |
| $C_{10}$ P + O + N | 0.54 | 0.26 | 0.22 |
| $C_{11}$+ & Unknowns | 3.70 | 6.62 | 5.60 |
| $C_5$+ Properties | | | |
| R + O/M + O | 88.3/77.3 | 96.2/86.0 | 94.7/84.7 |
| Molecular Weight | 85.7 | 91.8 | 90.6 |
| Density @ 60° F., g/ml | 0.77 | 0.80 | 0.79 |
| Reid Vapor Pressure, psia | 4.9 | 3.9 | 4.0 |

TABLE 9

Example 5: Material Balance Data
Feed: 14/86 v/v Pyrolysis Gasoline/Reformate Cut Blend

| Material Balance Number | Feed | 1 | 2 |
|---|---|---|---|
| Hours on Stream | — | 3 | 8 |
| Reactor Pressure, psig | — | 190 | 190 |
| Avg. Reactor Temperature, °F. | — | 800 | 799 |
| Total HC Feed WHSV, $hr^{-1}$ | — | 1.0 | 1.0 |
| Benzene/$C_2$–$C_9$ Olefins, mol/mol | 2.74 | 2.74 | 2.74 |
| Benzene/$C_2$–$C_9$ Olefins, wt/wt | 2.59 | 2.59 | 2.59 |
| $C_2$–$C_9$ Olefin Conversion, % | — | 57.5 | 49.8 |
| $C_5$–$C_9$ Olefin Conversion, % | — | 77.9 | 76.0 |
| Benzene Conversion, % | — | 45.8 | 42.0 |
| Composition, wt % of hydrocarbon | | | |
| Hydrogen | 0.00 | 0.15 | 0.03 |
| Methane | 0.00 | 0.44 | 0.42 |
| Ethane | 0.00 | 1.17 | 1.16 |
| Ethene | 0.00 | 0.20 | 0.26 |
| Propane | 0.00 | 10.57 | 9.57 |
| Propene | 0.00 | 0.57 | 0.81 |
| N-Butane | 0.00 | 3.99 | 3.76 |
| Isobutane | 0.00 | 3.92 | 3.49 |
| Butenes | 0.01 | 1.08 | 1.31 |
| Total $C_5$+ | 99.99 | 77.90 | 79.19 |
| $C_5$–$C_9$ Isoparaffins | 33.40 | 23.24 | 25.10 |
| $C_5$–$C_9$ N-Paraffins | 20.92 | 7.01 | 8.36 |
| $C_5$–$C_9$ Olefins | 9.05 | 2.00 | 2.17 |
| $C_5$–$C_9$ Naphthenes | 5.46 | 1.91 | 2.11 |
| $C_6$–$C_9$ Aromatics | 27.93 | 35.25 | 34.49 |
| $C_{10+}$ & Unknowns | 3.25 | 8.49 | 6.96 |
| Benzene | 23.45 | 12.71 | 13.61 |
| Toluene | 3.10 | 6.83 | 6.24 |
| Ethylbenzene | 0.20 | 5.81 | 5.99 |
| Xylenes | 0.49 | 4.15 | 3.47 |
| $C_9$ Aromatics | 0.68 | 5.75 | 5.18 |
| $C_{10}$ Aromatics | 0.56 | 2.34 | 1.92 |
| $C_{10}$ P + O + N | 0.33 | 0.06 | 0.05 |
| $C_{11}$+ & Unknowns | 2.36 | 6.09 | 4.99 |
| $C_5$+ Properties | | | |
| R + O/M + O | 80.5/74.6 | 95.6/85.5 | 93.3/85.1 |
| Molecular Weight | 88.2 | 95.7 | 94.3 |
| Density @ 60° F., g/ml | 0.73 | 0.77 | 0.76 |
| Reid Vapor Pressure, psia | 4.8 | 4.1 | 4.2 |
| Sulfur, ppmw | 91 | N/A | 38[a] |

[a]- total liquid product

TABLE 10

Example 2 - Detailed Sulfur GC Results (MB-1)
Feed: 75/25 v/v FCC Light Naphtha (215-°F.)/Reformate Cut Blend

| | Feed | TLP |
|---|---|---|
| Wt % of Feed | 100 | 84 |
| Composition, ppm | | |
| Total S | 187 | 75 |
| Thiophene (T) | 77 | 15 |
| $C_1$–T | 100 | 21 |
| $C_2$–T | 3 | 9 |
| $C_3$+T | 0 | 14 |
| Total Thiophenes | 179 | 59 |
| Benzothiophene (BTH) | <1 | 1 |
| $C_1$–BTH | 1 | 3 |
| $C_2$+BTH | 0 | 4 |
| Total BTH | 1 | 8 |
| Total $H_2S$ + Mercaptans | 7 | 7 |
| Dissolved $H_2S$ | 0 | 5 |
| $C_1$–$C_3$ Mercaptan | 0 | 2 |
| Net Conversion, wt %[a] | | |
| Total S | 67 | |
| Thiophene | 84 | |
| $C_1$–Thiophene | 82 | |
| Overall Thiophene | 72 | |

[a]Assumed negligible $C_5$+ range sulfur in gas product.

While the invention has been described by reference to specific embodiments there is no intent to limit the scope of the invention except as described in the appended claims.

What is claimed is:

1. A process for alkylating a benzene-rich gasoline boiling range hydrocarbon feedstream with a hydrocarbon stream comprising $C_5$+ olefins to produce product gasoline having a reduced benzene content and containing aromatics comprising substantially entirely $C_{10}$– alkylated aromatics, said process comprising:

contacting said benzene-rich stream and said $C_5$+ olefin stream in a fluidized bed with solid, shape selective aluminosilicate catalyst particles in a catalyst bed under benzene alkylation conditions whereby an effluent stream is produced comprising said gasoline having a reduced benzene content and in which the aromatics which are present are substantially entirely $C_{10}$– alkylated aromatics.

2. The process of claim 1 wherein said catalyst comprises acidic ZSM-5.

3. The process of claim 1 wherein said benzene alkylation conditions comprise temperature between 500° F. and 1000° F., pressure between about 50 (350 kPa) and 3000 psig (21000 kPa), and liquid hourly space velocity between 0.1 and about 250.

4. The process of claim 3 wherein said benzene alkylation conditions comprise temperature 700°–850° F. (371°–454° C.), pressure between 50–400 psig (350–2860 kPa), and liquid hourly space velocity between about 1 and 100.

5. The process of claim 1 wherein said hydrocarbon stream comprising $C_5$+ olefins comprises cracked gasoline.

6. The process of claim 5 wherein said cracked gasoline is selected from the group consisting of FCC gasoline, TCC gasoline, coker gasoline and pyrolysis gasoline.

7. The process of claim 1 wherein said product gasoline also has a lower Reid vapor pressure than the gasoline boiling range feedstream.

8. The process of claim 1 wherein said product gasoline has a lower sulfur content relative to said gasoline feedstream.

9. The process of claim 1 wherein said benzene content is lowered by at least 25 weight percent relative to said hydrocarbon feedstream.

10. A process for the reduction of the benzene and olefin content of $C_5$+ FCC gasoline feedstream containing benzene and $C_5$+ olefins, said process comprising:

contacting the $C_5$+ FCC gasoline feedstream with solid, shape selective aluminosilicate catalyst particles in a fluidized catalyst bed under benzene alkylation conditions whereby the benzene in the feedstream is alkylated with the $C_5$+ olefins of the feedstream to produce an effluent stream comprising said gasoline having a reduced benzene and olefin content in which the aromatics which are present are substantially entirely $C_{10}$− alkylated aromatics.

11. The process of claim 10 wherein at least a 25 weight percent reduction in benzene content and at least a 60 weight percent reduction in $C_{5+}$ olefin content is achieved.

12. The process of claim 10 wherein said catalyst comprises ZSM-5.

13. The process of claim 10 wherein said benzene alkylation conditions comprise temperature 700°–850° F. (371°–454° C.), pressure between 50–400 psig (350–2860 kPa), and liquid hourly space velocity between about 1 and 100.

14. The process of claim 10 wherein said effluent stream has a lower Reid vapor pressure than the gasoline feedstream.

15. The process of claim 10 wherein said effluent stream has a lower sulfur content relative to said gasoline feedstream.

16. In the process for reducing the benzene content of a reformate feedstream containing benzene, the process comprising alkylating the reformate feedstream with olefins in a fluidized bed in contact with shape selective metallosilicate catalyst particles, the improvement comprising:

alkylating said reformate feedstream with higher olefins comprising a $C_5$+ olefin rich feedstream to alkylate the benzene of the reformate feedstream with the $C_5$+ olefins whereby an effluent stream is produced comprising said reformate having a reduced benzene content in which the aromatics which are present are substantially entirely $C_{10}$− alkylated aromatics.

17. The process of claim 16 wherein said catalyst comprises acidic ZSM-5.

18. The process of claim 16 wherein said effluent stream has a lower Reid vapor pressure and lower sulfur content relative to said $C_5$+ feedstream.

19. The process of claim 16 wherein at least a 60 weight percent reduction in $C_{5+}$ olefin content of said reformate feedstream is achieved.

20. A process for lowering the benzene and olefin content of a benzene-rich and $C_5$+ olefin-rich $C_5$+ gasoline feedstream comprising:

contacting said feedstream with solid, shape selective aluminosilicate catalyst particles in a fluidized catalyst bed under benzene alkylation conditions whereby the benzene of the feedstream is alkylatd with $C_5$+ olefins of the feedstream to produce an effluent stream comprising a gasoline feedstream having a reduced benzene and olefin content relative to the feedstream and in which the aromatics which are present are substantially entirely $C_{10}$− alkylated aromatics.

21. The process of claim 20 wherein said catalyst comprises acidic ZSM-5.

22. The process of claim 20 wherein at least a 25 weight percent reduction in benzene content and at least a 60 weight percent reduction in $C_{5+}$ olefin content is achieved.

23. The process of claim 20 wherein said benzene alkylation conditions comprise temperature 700°–850° F. (371°–454° C.), pressure between 50–400 psig (350–2860 kPa), and liquid hourly space velocity between about 1 and 100.

* * * * *